US006199235B1

(12) United States Patent
Spahn et al.

(10) Patent No.: US 6,199,235 B1
(45) Date of Patent: Mar. 13, 2001

(54) HAND CHECK TUNNELLED MATTRESS COVER

(75) Inventors: James G. Spahn; Robert K. Ellis, both of Indianapolis; David Laughlin, Mooresville, all of IN (US)

(73) Assignee: EHOB, Inc., Indianapolis, IN (US)

( * ) Notice: Subject to any disclaimer, the term of this patent is extended or adjusted under 35 U.S.C. 154(b) by 0 days.

(21) Appl. No.: 09/615,544

(22) Filed: Jul. 13, 2000

Related U.S. Application Data

(60) Provisional application No. 60/143,421, filed on Jul. 13, 1999.

(51) Int. Cl.[7] ..... A61G 7/057; A47C 27/08

(52) U.S. Cl. ..... 5/737; 5/738; 5/694; 5/706

(58) Field of Search ..... 5/694, 706, 710, 5/727, 728, 737, 738

(56) References Cited

U.S. PATENT DOCUMENTS 2,162,021 * 6/1939 Kidwell ..... 5/694
3,110,042 * 11/1963 Slemmons ..... 5/728
3,534,417 * 10/1970 Boyles ..... 5/728
4,317,244 * 3/1982 Balfour-Ritchie ..... 5/738 X

* cited by examiner

*Primary Examiner*—Michael F. Trettel
(74) *Attorney, Agent, or Firm*—Woodard, Emhardt, Naughton, Moriarty & McNett

(57) ABSTRACT

A mattress cover for use with air inflated mattresses that includes an integral hand check tunnel formed as part of the cover. The cover includes a top, a bottom, and sides extending between the top and bottom. Openings are formed along the longitudinal sides of the cover and permit access to an enclosed tunnel that extends between the sides of the mattress cover. Flaps are attached to the sides of the mattress cover over the openings along with devices for selectively opening and closing the openings. A caregiver can verify proper inflation of an air mattress placed within the cover by opening the flaps and extending a hand into the tunnel. The cover can be used with a single air inflated air mattress with the tunnel overlying the mattress, in a dual configuration where one air mattress is placed over the other with the tunnel being placed between the mattresses, or with an air mattress placed upon a foam base with the tunnel being placed between the mattress and foam base.

1 Claim, 4 Drawing Sheets

HAND CHECK TUNNELLED MATTRESS COVER

This application claim benefit to Provisional application Ser. No. 60/143,421 filed Jul. 13, 1999.

The present invention relates to mattress covers generally, and more particularly to mattress covers for air inflated mattresses for therapeutic uses.

BACKGROUND OF THE INVENTION

Patients that are bedridden for appreciable periods of time often develop persistent and painful bedsores. The relatively inactive bedridden patients in hospitals, nursing homes, and home care have a high incidence of decubitus ulcers or bedsores. It is generally recognized that this phenomenon is caused by the relatively high pressures experienced at crucial points on the patient's body where body weight is concentrated but the thickness of the flesh between the skeletal structure and the supporting surface is minimum.

SUMMARY OF THE INVENTION

The present invention is directed toward a new mattress cover for air inflated mattresses for therapeutic uses, having an integral hand check tunnel to allow a caregiver to verify proper patient support of an air inflated mattress within the mattress cover. The hand check tunnel allows such verifications with minimal disruption to the patient and without the caregiver coming into contact with patient contaminates and excrements.

The invention will be used when a single air inflated mattress is placed within a mattress cover, in a dual configuration where one air inflated mattress is placed on top of another and then both placed within a mattress cover, or where an air inflated mattress is placed on top of a foam base and then both are placed within a mattress cover. In a mattress system using a single air inflated mattress, the air mattress is placed on top of the hand check tunnel of the present invention. In a mattress system using dual air inflated mattresses, the hand check tunnel of the present invention is placed between the two mattresses. In a mattress system using a single air inflated mattress with a foam base, the hand check tunnel of the present invention is placed between the mattress and the foam base.

One preferred embodiment of the present invention is a hand check tunnelled mattress cover comprising, a mattress cover for air inflated mattresses for therapeutic use, having a top, a bottom, and sides therebetween defining the cover, including its width and length dimensions; corresponding openings in the opposing sides of the cover midway along its length dimension; an enclosed tunnel within and independent of the top and bottom of the cover connecting the openings in the opposing sides of the cover; and flaps attached to the cover above the openings with devices for selectively opening and closing the openings.

A principal object of the present invention is to allow a caregiver to verify proper inflation of an air inflated patient mattress (support) with minimal disruption to patient.

It is a further object of the present invention to minimize contamination within an air inflatable mattress cover by providing an isolated passage to verify proper support between materials.

It is a further object of the present invention to minimize contamination within container, yet still allow a hand check to be performed without opening of the mattress cover.

It is a further object of the present invention to provide an area to install a heating or cooling device (fluid as medium) to adjust body temperature.

BRIEF DESCRIPTION OF THE DRAWING FIGURES

DETAILED DESCRIPTION OF THE PREFERRED EMBODIMENT

Figure 1:
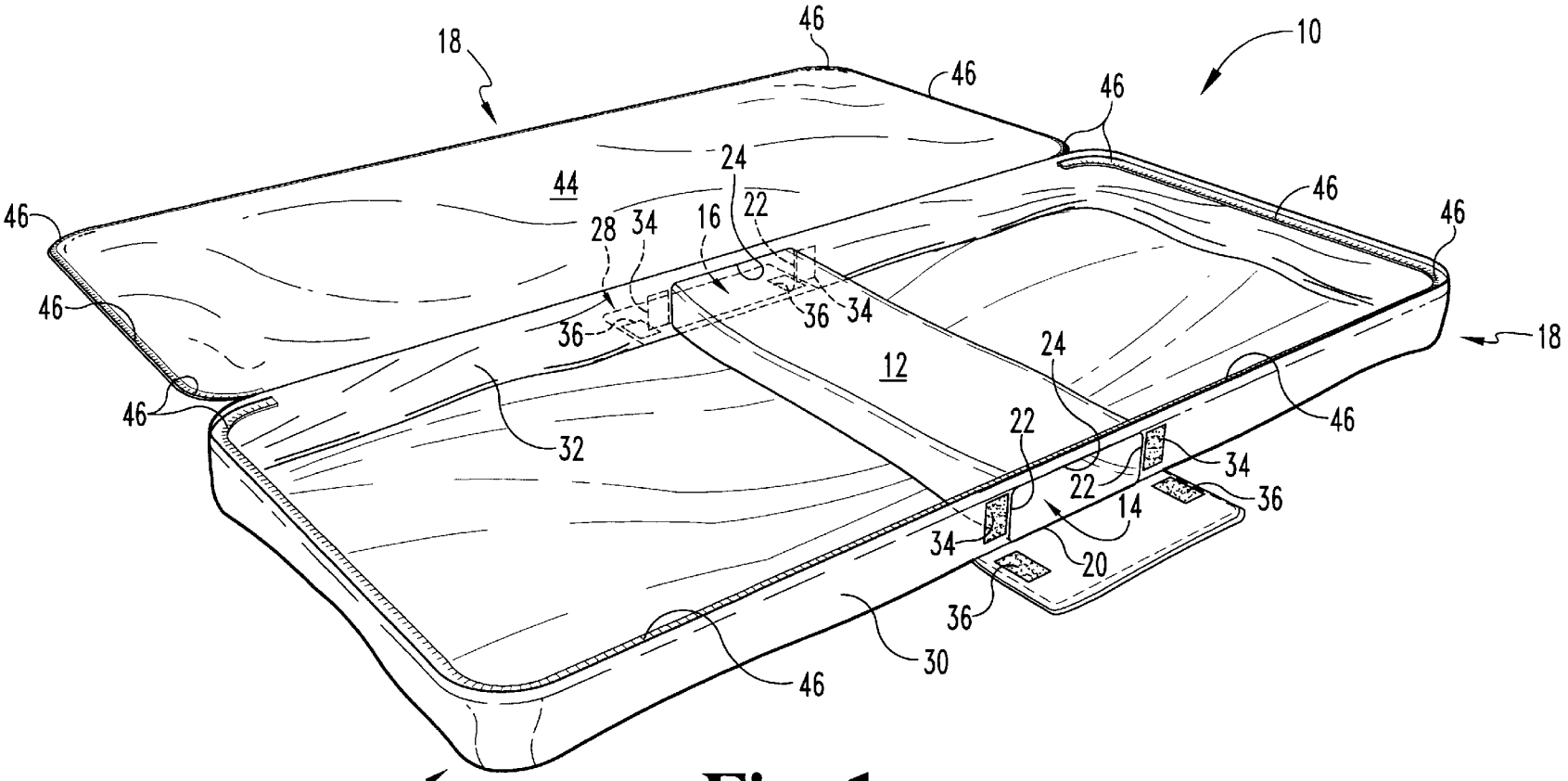
FIG. 1 is a perspective bottom view of the top half of the hand check tunnelled mattress cover of the present invention, also showing the attached bottom half of hand check tunnelled mattress cover.

A 200 Denier Oxford Nylon 4.6 oz. polyurethane coated fabric with ABFR additives is the preferred fabric used to date to construct the hand check tunnelled mattress cover 10 of the present invention. This preferred fabric is also low vapor permeable (LVP) and moisture impermeable, which releases heat generated by the body. The LVP fabric keeps moisture from entering the mattress cover, thus eliminating a breeding ground for living organism and eliminating bioaerosols. The hand check tunnel 12 of mattress cover 10 provides a means to check for proper inflation of air inflated matresses placed within the cover, thereby eliminating the need for a caregiver to come into direct contact with any patient contaminates and excrements on the cover 10. The hand check tunnel 12 also eliminates any possible contamination within the mattress cover 10, thus reducing or eliminating bioaerosols.

To form the hand check tunnel 12, the preferred fabric is cut into a long rectangular form, folded in half lengthwise, and then sewn together along the open lengthwise side, resulting in a tunnel configuration. This is then turned inside out. The fabric is then attached at the open ends 14, 16 of the hand check tunnel 12 by conventional sewing techniques, to a conventionally formed mattress cover 18. Both open ends 14, 16 of hand check tunnel 12 are attached along their top 20, sides 22, and bottom 24 to the sides of the mattress cover 18, where a rectangular opening has been cut in the cover corresponding to the dimensions of open ends 14, 16 of the hand check tunnel 12. The hand check tunnel 12 is orientated centered and perpendicular to the length of the mattress cover 18. The openings at both ends 14, 16 of hand check tunnel 12 are coverable with fabric flaps 26, 28, which have been fabricated like pillow covers. These fabric flaps 26, 28 are sewn to the outside of the mattress cover 18, above the tunnel openings 20. The fabric flaps 26, 28 are removably securable to the sides 30, 32 of the cover 18 by means of a hook material 34 on both sides of the openings 14, 16 and a loop material 36 on the backside of the corresponding side edges of the tunnel flaps 26, 28. The open ends 14, 16 of hand check tunnel 12 may then be covered with flaps 26, 28 to close the hand check tunnel openings 14, 16.

Figure 2:
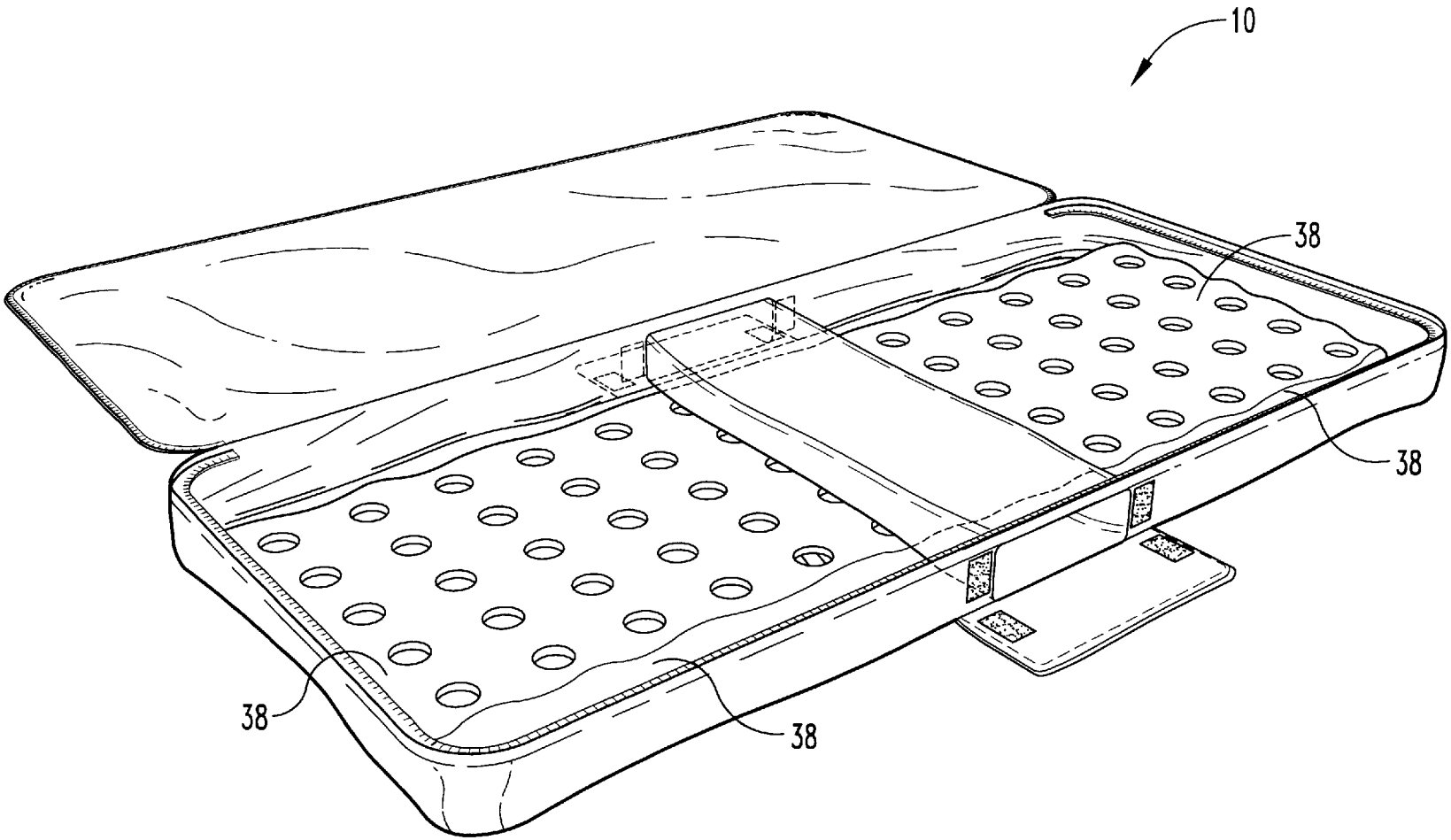
FIG. 2 is a perspective bottom view of the top half of the hand check tunnelled mattress cover of the present invention of FIG. 1 with a single air inflated mattress.
Figure 3:
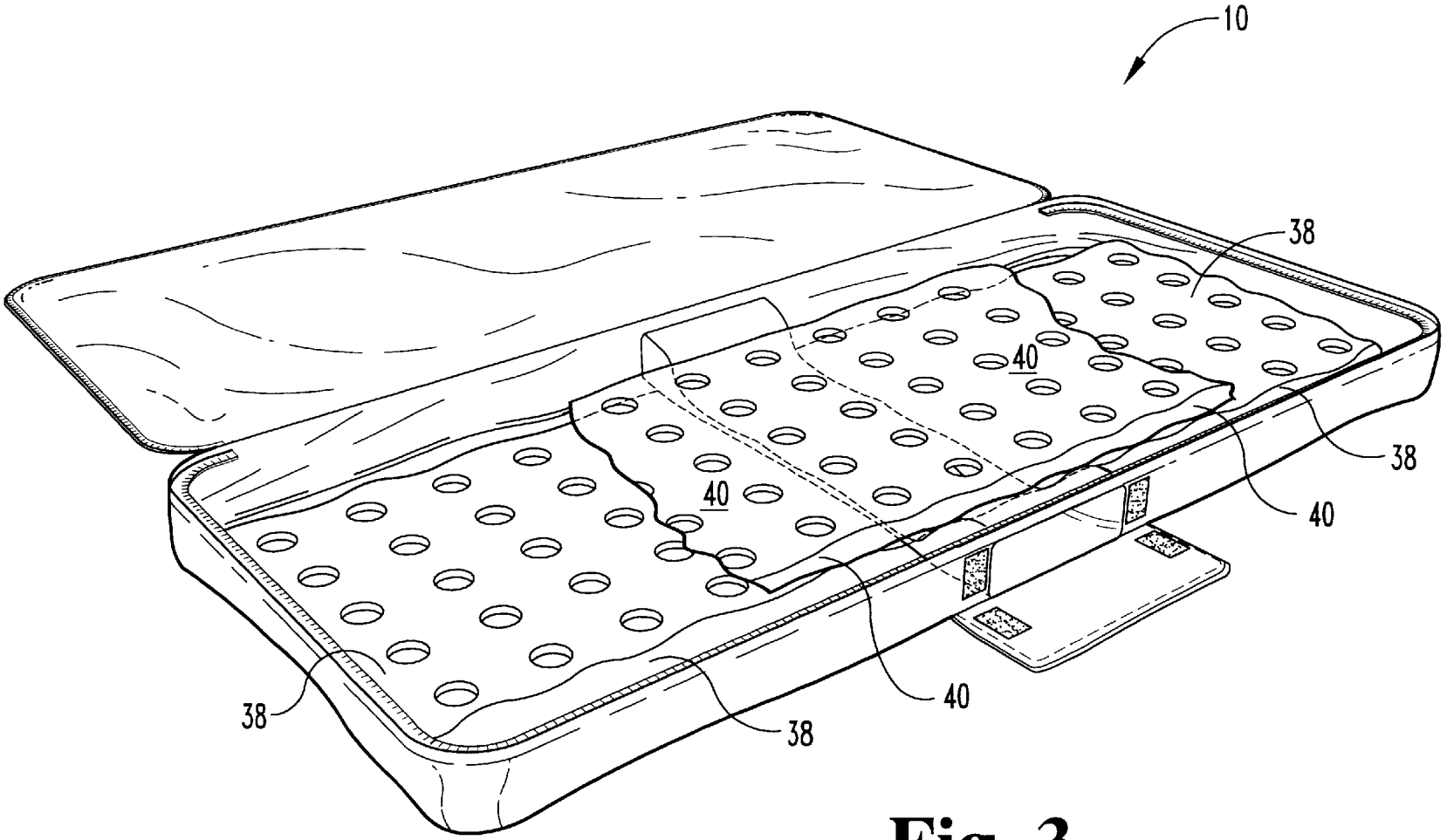
FIG. 3 is a partially segmented perspective bottom view of the top half of the hand check tunnelled mattress cover of FIG. 1 with the hand check tunnel between two air inflated mattresses.
Figure 4:
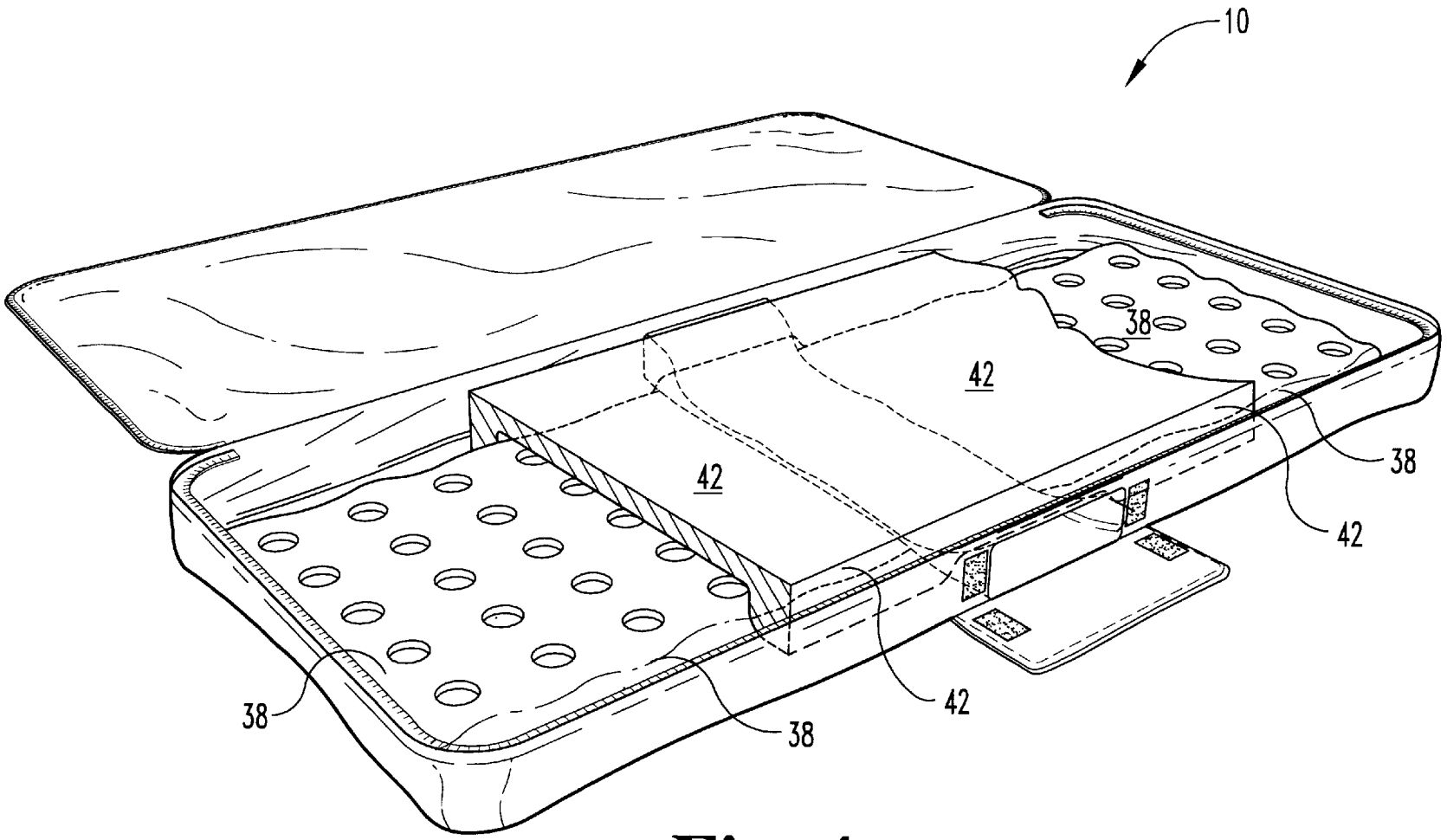
FIG. 4 is a partially segmented perspective bottom view of the top half of the hand check tunnelled cover of FIG. 1 with the hand check tunnel between a foam base and a single inflated air mattress.

The hand check tunnel 12 is used to verify proper inflation for proper support of a patient, by a caregiver, of a single air inflated mattress 38 placed within mattress cover 18 (FIG. 2). The hand check tunnel 12 may also be used to verify proper inflation for proper patient support when placed between two air inflated mattresses 38, 40 (FIG. 3). The hand check tunnel 12 may also be used to verify proper inflation when placed between a foam base 42 and a single air inflated mattress 38 (FIG. 4).

A patient caregiver opens one of the flaps 26, 28 of hand check tunnel 12 and inserts either their right or left hand, palm up, into one of the open ends 14, 16 of hand check tunnel 12. The caregiver inserts their hand into the hand check tunnel 12 until their hand is under the patient's buttocks. This operation is performed in this way to verify proper inflation of the air inflated mattress beneath and supporting the patient for proper support of the patient. In this regard, note that the views of FIGS. 1–4 are bottom views. Once the bottom of the mattress cover 44 is closed and zipped shut, using typical zipper 46, the entire mattress cover 10 of FIGS. 1–4 is inverted top to bottom from the orientation shown in FIGS. 1–4 before a patient is placed on the top surface of the cover 18. It can then be appreciated that the hand check tunnel 12 will always have a single air inflated mattress 38 between a patient and the hand check tunnel 12.

We claim:

1. A hand check tunnelled mattress cover comprising, a mattress cover for air inflated mattresses for therapeutic use, having a top, a bottom, and sides therebetween defining the cover, including its width and length dimensions;

corresponding openings in the opposing sides of the cover midway along its length dimension;

an enclosed tunnel within and independent of the top and bottom of the cover, connecting the openings in the opposing sides of the cover; and flaps attached to the cover above the openings having means for selectively opening and closing the openings.

* * * * *